US005262193A

United States Patent [19]

Louks et al.

[11] Patent Number: 5,262,193

[45] Date of Patent: Nov. 16, 1993

[54] ULTRASONICALLY ASSISTED COATING METHOD

[75] Inventors: John W. Louks, North Hudson, Wis.; Donald L. Pochardt, Hastings; Robert B. Secor, Stillwater, both of Minn.; Karl J. Warren, Hudson, Wis.

[73] Assignee: Minnesota Mining and Manufacturing Company, St. Paul, Minn.

[21] Appl. No.: 928,620

[22] Filed: Aug. 10, 1992

Related U.S. Application Data

[63] Continuation of Ser. No. 775,436, Oct. 15, 1991, abandoned.

[51] Int. Cl.[5] ..... B05D 3/14

[52] U.S. Cl. ..... 427/8; 427/299; 427/346; 427/355; 427/560; 427/600

[58] Field of Search ..... 427/57, 600, 560, 299, 427/346, 355, 8; 118/712

[56] References Cited

U.S. PATENT DOCUMENTS

| | | | |
|---|---|---|---|
| 3,676,216 | 7/1972 | Abitboul | 427/57 |
| 4,237,181 | 12/1980 | Tanabe et al. | 427/57 X |
| 4,246,865 | 1/1981 | Shimada et al. | 427/57 X |
| 4,302,485 | 11/1981 | Last et al. | 427/57 |
| 4,307,128 | 12/1981 | Nagano et al. | 427/57 |
| 4,532,166 | 7/1985 | Thomsen et al. | 428/57 |
| 4,858,264 | 8/1989 | Reinhart | 15/93 |

FOREIGN PATENT DOCUMENTS

| | | |
|---|---|---|
| 869959 | 5/1971 | Canada . |
| 0096433 | 12/1983 | European Pat. Off. . |
| 2017704 | 11/1971 | Fed. Rep. of Germany . |
| 56-147656 | 11/1981 | Japan . |
| 57-187071 | 11/1982 | Japan . |
| 59-225772 | 12/1984 | Japan . |
| 60-180938 | 9/1985 | Japan . |
| 63-242374 | 10/1988 | Japan . |
| 3065267 | 3/1991 | Japan . |
| 4010902 | 1/1992 | Japan . |
| 551184 | of 1975 | U.S.S.R. . |
| 770560 | 2/1981 | U.S.S.R. . |

OTHER PUBLICATIONS

"The Effect of Ultrasonic Vibration on Polymers in Fluid State"; M. L. Fridman et al. (No date available).

"Flow of Thermoplastics in Dies with Oscillating Boundary"; A. I. Isayev et al. (no date available).

"Ultrasonic Enhancement of Epoxy Matrix Pultrusions"; Noel J. Tessier et al.; 41st Annual Conf, Reinforced Plastics/Composites Institute; Jan. 1986.

*Primary Examiner*—Bernard Pianalto

*Attorney, Agent, or Firm*—Gary L. Griswold; Walter N. Kirn; Charles D. Levine

[57] ABSTRACT

An ultrasonically assisted coating method for applying a smooth layer of coating material on a surface of a moving web are disclosed. A coating material is applied onto one web surface. An ultrasonic energy generator excites the line of initial contact between the coating material and the web at a uniform ultrasonic intensity selected in combination with the properties of the coating material. The coated web has a thin, uniform cross-web thickness with low thickness variations.

12 Claims, 6 Drawing Sheets

ULTRASONICALLY ASSISTED COATING METHOD

This is a continuation of application Ser. No. 07/775,436 filed Oct. 15, 1991, now abandoned.

TECHNICAL FIELD

The present invention relates to an acoustically assisted coating apparatus and a method for applying one or more layers of a coating material onto a moving web. More particularly, the present invention relates to using ultrasonic energy to improve the application of a smooth, uniform layer of coating material onto a moving web.

BACKGROUND OF THE INVENTION

Ultrasonically created fluid effects have been noted in the literature since the early 1900's. Since the 1960's, the development of improved transducers for generating ultrasonic energy increased activity in this field. Ultrasonic phenomena which relate to fluid processing or coating technologies include cavitation, viscous heating, increased shear, microturbulence, and acoustic streaming. These phenomena generate effects that include enhanced wettability, micromixing, dispersion, emulsification, deaeration, agglomeration, separation of components, viscosity reduction, polymer chain disentanglement, high polymer degradation, and increased chemical reaction rates.

Last, et al., U.S. Pat. No. 4,302,485, discloses using ultrasonic energy in an immersed saturation system to excite a strip of fabric passing through a bath of liquid finishing agent. This causes cavitation in the bath and increases the microturbulence to thereby increase wicking. The fabric is impregnated from both sides, and the liquid is not metered onto the fabric.

In U.S. Pat. No. 4,307,128 to Nagano, et al., ultrasonic energy is used in a molten metal bath to locally lift a portion of the molten metal surface such that it contacts a moving surface of a substrate. The coating is not metered. Absent ultrasonic energy, this apparatus is apparently inoperative.

U.S. Pat. No. 3,676,216 to Abitboul teaches applying ultrasonic energy to a previously coated web to more uniformly and consistently distribute the coating over the web and to smooth irregularities in the coating. However, the ultrasonic energy is transmitted through the air to excite the coated web after the web is completely coated.

Japanese Patent No. 57-187071 discloses applying ultrasonic energy to the backside of a coated web. However, the ultrasonic source is too far from the point of coating for the ultrasonic energy to affect the liquid at the first contact between the liquid and the web or at the last contact between the liquid and the coating equipment.

In Canadian Patent No. 869,959, a nozzle for applying a liquid coating from a hopper onto a moving web is ultrasonically excited. A horn ultrasonically vibrates the nozzle to prevent the coating from sticking in and clogging the nozzle. However, the ultrasonic vibrations only affect the coating before it is placed on the web, and do not affect the process during the initial contact between the coating and the web or thereafter. Thus, the ultrasonic vibrations do not affect the uniformity of the thickness of the coating as the coating is applied. The Canadian patent is representative of a body of art which discloses applying ultrasonic energy to a nozzle during coating to improve flow through and from the nozzle. However, these apparatus are not practical for use in large scale production applications where wide coatings are being applied. In the formation of web rolls such as adhesive tapes, it is common to form the rolls in up to 150 cm (60 inch) widths. Rolls this size could not be formed while achieving uniform ultrasonic excitation of sufficient intensity at the nozzle due to the difficulty in exciting the necessary masses and lengths involved.

None of the known apparatus or systems disclose metering the coating onto only one side of the web and using acoustic energy to improve the characteristics of an applied coating before the coating of the web is complete.

SUMMARY OF THE INVENTION

The present invention overcomes these problems and uses acoustic energy to assist the coating of a smooth continuous or discontinuous layer of a metered quantity of liquid coating material having a substantially uniform crossweb thickness on one surface of a moving web. The apparatus includes a device which applies a coating material onto at least a portion of the surface of the web. The device may be any type of coating system in which the coating can be applied onto one side of the web, such as, for example, extrusion, curtain, slot-fed knife, hopper, fluid bearing, notch bar, blade, and roll coaters.

A coating applicator meters and applies a controlled amount of coating material onto one surface of the web across the width of the web. An ultrasonic energy source excites the line of initial contact between the coating material and the web preferably at a uniform acoustic intensity, amplitude, and frequency in the low end of the ultrasonic spectrum. Where a downweb structure is used as part of the die or as a separate structure to level or smooth the coating, the ultrasonic energy source can excite the line of final contact between the coating applicator device or downweb structure and the coated web. Additionally, the ultrasonic energy can excite the area between the region of initial contact of the coating material and the web and the region of final contact between the coating applicator device or downweb structure and the coating material. The acoustic intensity is selected in combination with the properties of the coating material and the web to create a coated web having a substantially uniform crossweb thickness.

When the coating material is applied through a die, the ultrasonic energy generator can apply ultrasonic energy to the coating material-web interface through the die. Alternatively, ultrasonic energy is applied through the back surface of the web, through a backup horn which replaces a conventional support. The ultrasonic energy can also be transmitted through the air or other coupling fluid.

BRIEF DESCRIPTION OF THE DRAWINGS

FIG. 1 schematically illustrates contact extrusion.

FIG. 2 schematically illustrates curtain coating.

FIG. 3 schematically illustrates slot-fed knife coating.

FIG. 4 schematically illustrates slide coating.

FIG. 5 schematically illustrates roll coating.

FIG. 6 schematically illustrates non-contact extrusion coating.

DETAILED DESCRIPTION OF PREFERRED EMBODIMENTS

Figure 1A:
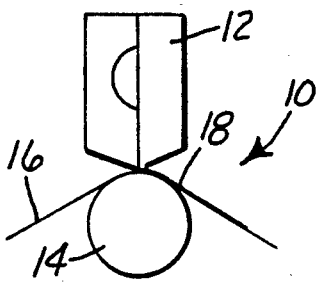
FIG. 1A shows contact extrusion without acoustic excitation and FIGS. 1B, 1C, 1D, 1E, 1F, and 1G show contact extrusion with various ways of applying acoustic energy.

The apparatus and coating method of the present invention apply acoustic energy to the interface between a web and a liquid coating material applied on the web. Although acoustic energy can be applied at various locations in all coating systems, improved coating is best achieved in systems which coat the web on one surface. With this system acoustic energy is used to improve coating thickness uniformity on the coated web, increase wettability (the ability of a liquid to replace a gas in contact with a substrate), reduce edge beads and streaks, reduce viscous drag, increase the coating gap between the coating equipment and the web, yield more stable equipment operation and self-cleaning equipment, reduce the tendency for air entrainment, coat at higher speeds, and reduce the minimum possible coating thickness. The increased coating uniformity reduces distortion, peaking and gapping, high spots, and telescoping of wound rolls of coated webs.

This invention is described with respect to applying smooth, continuous coatings. Nonetheless, these results also can be attained while applying smooth discontinuous coatings. For example, ultrasonic energy can be used with the coating of a web having a macrostructure such as voids which are filled with a coating but there is not continuity between the coating in adjacent voids. In this situation, the coating uniformity and enhanced wettability is maintained both within discrete coating regions and from region to region, with the regions separate from each other in both the downweb and crossweb directions.

The web can be any material such as polyester, polypropylene, paper, or nonwoven materials. The improved wetting of the coating is particularly useful in rough textured or porous webs, regardless of whether the pore size is microscopic or macroscopic.

The web and the coating material are excited at a preferably uniform ultrasonic intensity across the width of the coated web. The intensity is selected in combination with the coating material properties to maximize crossweb coating thickness uniformity. Although the frequency and amplitude can be varied while maintaining a uniform ultrasonic intensity, ultrasonic waves having uniform amplitude and frequency are preferred.

Acoustic waves are longitudinal waves caused by periodic compression and rarefaction of the medium through which they travel. These waves also can generate other acoustic waves such as surface transverse acoustic waves. Acoustic waves contain both kinetic energy of motion and potential energy of compressed matter. The acoustic energy density, E, is a measure of the energy per volume in an longitudinal acoustic wave and is represented by:

$$E=\pi^2\rho_O f^2 x_O$$

where $\rho_O$ is the density of the medium when no acoustic waves travel through it, f is the frequency of the acoustic wave, and $x_O$ is the peak-to-peak amplitude. Where differences in acoustic energy density occur, forces exist which can manipulate coating liquids.

The ultrasonic energy intensity, I, is a function of the amplitude and frequency of the waves and the properties of the medium and is represented by:

$$I=c\pi^2\rho_O f^2 x_O$$

where c is the speed of the acoustic waves in the medium.

When an acoustic wave encounters a boundary between two media, part of the wave is transmitted through and the rest is reflected from the boundary. The proportion of transmission to reflectance depends on how similar the acoustic impedances of the two media are. The characteristic acoustic impedance, R, is as follows:

$$R=\rho_O c.$$

If the impedances of two media are similar, most of the wave will be transmitted. If the impedances differ widely, most of the wave will be reflected. However, when a thin layer is sandwiched between two materials with similar acoustic impedances, the thin layer transmits the acoustic waves even though its impedance differs from that of the other materials.

The application of ultrasonic energy provides the desired results when used with any type of coaters in which the coating is metered or measured and applied to one surface of the web. Extrusion coaters, both contact and non-contact, are illustrated in FIGS. 1 and 6, respectively. Curtain coaters are illustrated in FIG. 2. Knife coaters include slot-fed knife, hopper, fluid bearing, notch bar, and blade coaters, and will be discussed with reference to a slot-fed knife coater as illustrated in FIG. 3. Slide coaters are illustrated in FIG. 4. Roll coaters include gravure and kiss coaters and are generically represented in FIG. 5. Although other types of coaters are also enhanced by the application of acoustic energy, the systems described below are representative. The operation of the invention is generally similar with all of these coating methods.

Referring to FIG. 1, a contact extrusion coating system is shown. In FIG. 1A, no ultrasonic excitation is provided. A coating system 10, includes an extrusion die 12 located adjacent a backup roller 14. A web 16 of material to be coated travels from left to right in the figure. Coating material 18 is extruded onto and across the web 16 as shown. The coating material 18 may be applied across the entire width of the web 16 or across any fraction of the width in the known manner.

In FIGS. 1B, 1C, 1D, 1E, 1F, and 1G, ultrasonic energy is applied to the system 10 such that the energy acts on the web 16 and coating 18 in the region of initial contact between the web 16 and coating 18. The details of this ultrasonic excitation are described below. In the coating system 10' of FIG. 1B, a resonant sonotrode or ultrasonic horn 20 replaces the backup roller 14. The ultrasonic horn 20 is a specially designed horn which can vibrate at selected frequencies or amplitudes of vibration. The ultrasonic energy is applied directly to the web 16 and excites the web 16 and coating 18 at the location of initial contact between the coating 18 and the web 16.

Figure 1B:
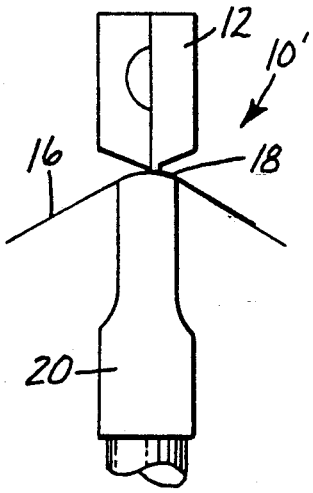
Figure 1C:
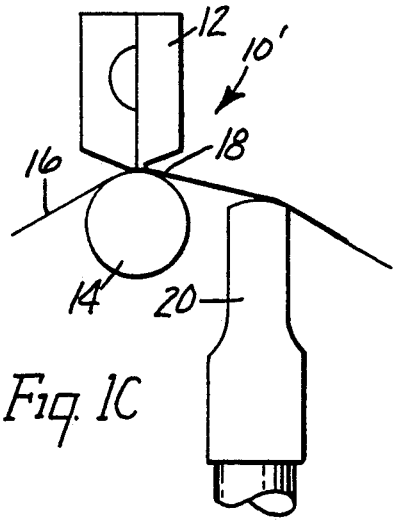

In FIG. 1C, both an ultrasonic horn 20 and a backup roller 14 are used in the coating system 10'. The backup rolier 14 is located opposite the extrusion die 12, and the ultrasonic horn 20 is located downweb from this location. The ultrasonic energy is applied directly to the coated web 16 and the energy travels through the web 16 and coating 18 to excite the line of initial contact between the coating 18 and the web 16. Although the horn 20 is shown downweb of the die 12, it also could be located upweb of the die 12. Additionally, although the ultrasonic energy is not applied directly to the line of initial contact between the coating 18 and the web 16, the energy is applied with a sufficient intensity such that when it reaches the initial contact line it has sufficient energy.

Figure 1D:
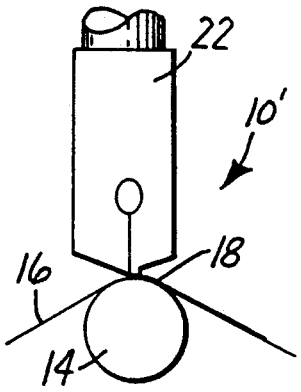

The coating system 10' of FIG. 1D includes similar components to the known system 10 of FIG. 1A. The web 16 passes around a backup roller 14 and the coating material 18 is extruded onto and across the desired width of the web 16. An extrusion die 22 applies the coating material 18 onto the web 16. However, in FIG. 1D, the die 22 is ultrasonically excited to excite the coating 18 within the die 22 and the excited coating 18 is extruded onto the web 16. The ultrasonic die 22 is a specially designed die connected to an ultrasonic energy generator, either in a single housing as shown, or by externally securing the two together as with a mounting bracket. The ultrasonic energy travels through the coating 18 to excite the region of initial contact between the coating 18 and the web 16.

Referring to FIG. 2, a curtain coating system is shown. In the coating system 26 of FIG. 2A, no ultrasonic excitation is provided. The curtain coating die 28 is spaced above the backup roller 14. The web 16 travels from left to right in the figure. The coating material 18 is extruded from the die 28 and falls in a curtain onto the web 16 across the desired width of the web 16.

Figure 2A:
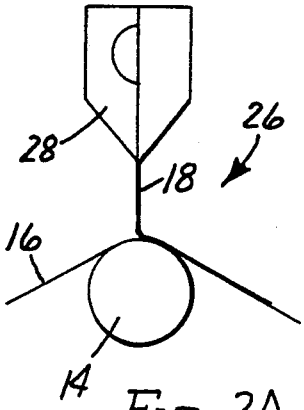
FIG. 2A shows curtain coating without acoustic excitation and FIGS. 2B, 2C, 2D, and 2E show curtain coating with various ways of applying acoustic energy.
Figure 2B:
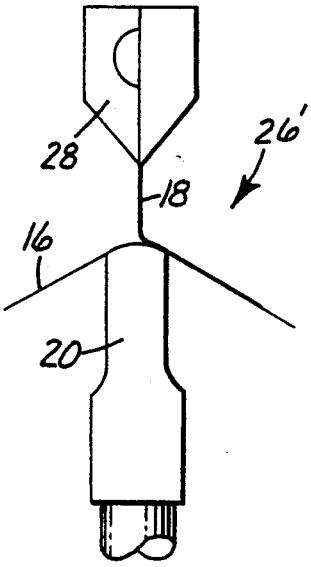
Figure 2C:
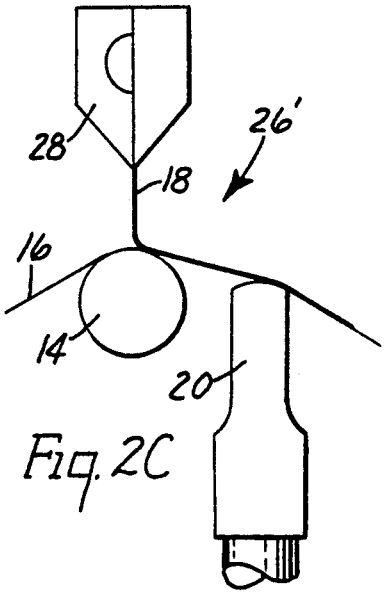

In FIG. 2B, ultrasonic energy is applied to the coating system 26' such that the energy acts on the web 16 and coating 18 in the region of initial contact between the web 16 and coating 18. The ultrasonic horn 20 replaces the backup roller 14. The ultrasonic energy is applied directly to the web 16 and excites the web 16 and coating 18 at the location of initial contact between the coating 18 and the web 16. In FIG. 2C, both an ultrasonic horn 20 and a backup roller 14 are used. The ultrasonic energy is applied directly to the coated web 16 and the energy travels upweb through the web 16 and coating 18 to excite the line of initial contact between the coating 18 and the web 16. Moreover, when the curtain length is short, an ultrasonic die (not shown) can be used in a manner similar to the system 10' of FIG. 1D.

Figure 2D:
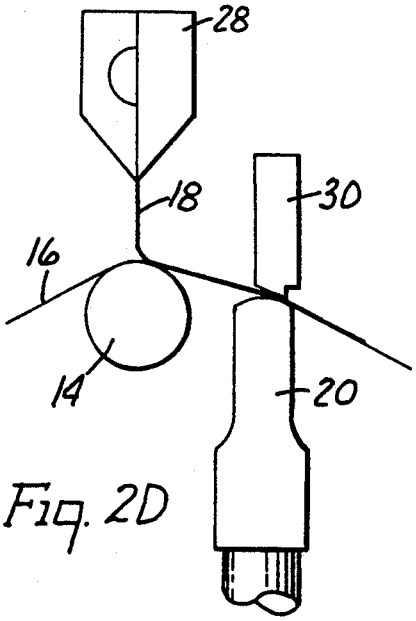
Figure 2E:
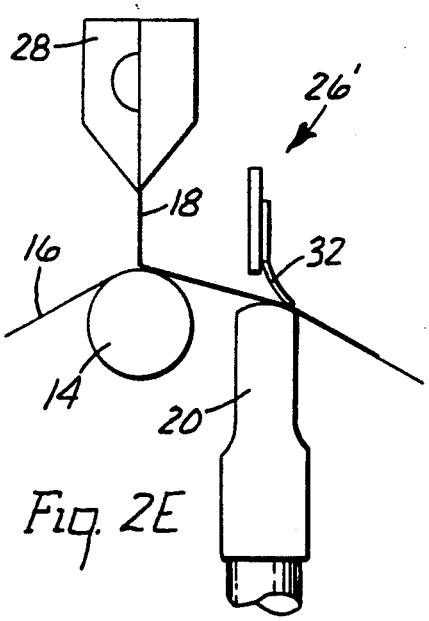

Additionally, a downweb structure such as a rigid leveling bar 30 shown in FIG. 2D, or a flexible leveling pad 32 shown in FIG. 2E may be used to smooth or level the coating material 18 after it is applied to improve the thickness uniformity. When a downstream element such as the leveling bar 30 or leveling pad 32 is used as part of the coating system 26', application of ultrasonic energy can be beneficially applied in the region of final contact between the coated web 16 and the downweb leveling structure. Thus, the ultrasonic energy need not reach the region of initial contact between the web 16 and the coating 18 as long as it reaches the region of final contact between the coated web 16 and the leveling bar 30 or leveling pad 32. The web beneath the leveling bar 30 and the leveling pad 32 can be supported (as shown) or unsupported. These devices can be directly ultrasonically excited. An ultrasonically excited unsupported structure could also be used to meter the fluid.

Referring to FIG. 3, a slot-fed knife die coating system 36 is shown. In FIG. 3A, no ultrasonic excitation is provided. The coating system 36 includes a slot-fed knife die 38 located adjacent to the backup roller 14. The web 16 of material to be coated travels from left to right in the figure, and the coating material 18 is deposited onto the web 16 across the desired web width as shown.

Figure 3A:
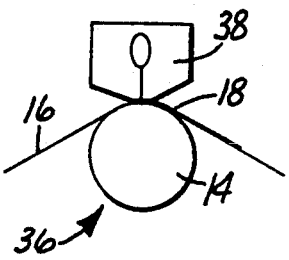
FIG. 3A shows slot-fed knife coating without acoustic excitation and FIGS. 3B, 3C, and 3D show slot-fed knife coating with various ways of applying acoustic energy.
Figure 3B:
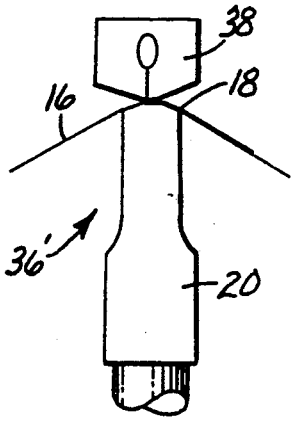
Figure 3C:
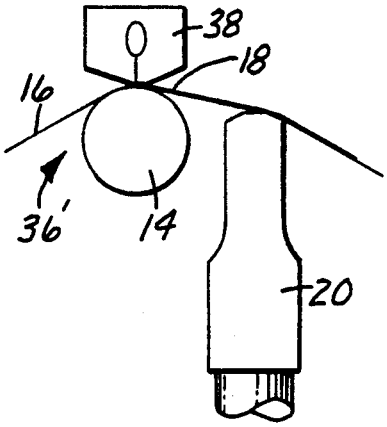
Figure 3D:
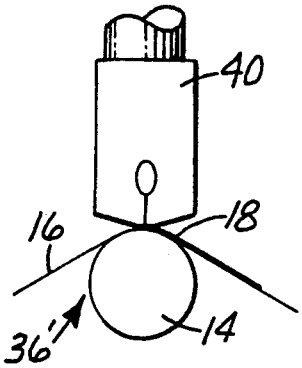

In FIGS. 3B, 3C, and 3D, ultrasonic energy is applied to the system 36' such that the energy acts on the web 16 and coating 18 in the region of initial contact between the web 16 and coating 18. In FIG. 3B, the ultrasonic horn 20 replaces the backup roller 14. The ultrasonic energy is applied directly to the web 16 and excites the web 16 and coating 18 at the location of initial contact between the coating 18 and the web 16, as well as the coating 18 between the die 38 and the horn 20. In FIG. 3C, both an ultrasonic horn 20 and a backup roller 14 are used. The ultrasonic energy is applied directly to the coated web 16 and the energy travels through the web 16 and coating 18 to excite the line of initial contact between the coating 18 and the web 16. In FIG. 3D, the knife die is ultrasonically excited and is shown as knife die 40. The coating 18 is excited while still within the knife die 40 and the energy travels through the coating 18 to the region of initial contact between the coating 18 and the web 16.

Additionally, the ultrasonic energy can excite the area between the region of initial contact of the coating material and the web and the region of final contact between the coating applicator device or downweb structure and the coating material. This applies to all discussed coating methods when downweb structures are used.

Figure 4A:
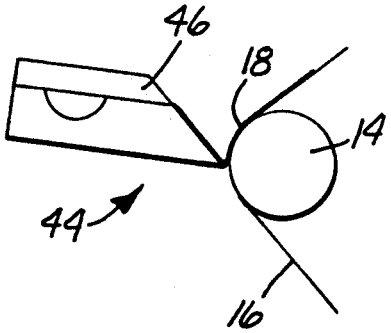
FIG. 4A shows slide coating without acoustic excitation and FIG. 4B shows slide coating with acoustic excitation.

Referring to FIG. 4, a slide coating system 44 is shown. In FIG. 4A, no ultrasonic excitation is provided. The coating system 44 is a slide die 46, and is located adjacent the backup roller 14. The web 16 of material to be coated travels from left to right in the figure and the coating material 18 is coated onto the web 16 as shown. The coating is applied across the desired width of the web 16.

Figure 4B:
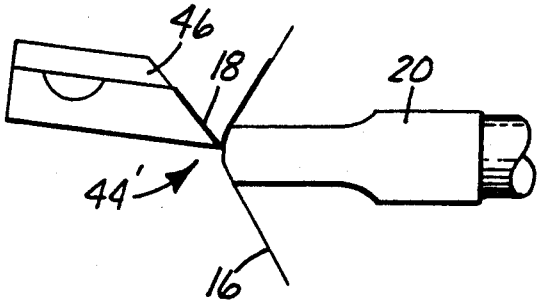

In FIG. 4B, ultrasonic energy is applied to the system 44' such that the energy acts on the web 16 and coating 18 in the region of initial contact between the web 16 and coating 18. The ultrasonic horn 20 replaces the backup roller 14 and the ultrasonic energy is applied directly to the web 16 and excites the web 16 and coating 18 at the location of initial contact between the coating 18 and the web 16. Moreover, an ultrasonic slide die (not shown) in which the coating 18 is excited while still within the slide die and the energy travels through the coating 18 to the region of initial contact between the coating 18 and the web 16 can be used.

Figure 5A:
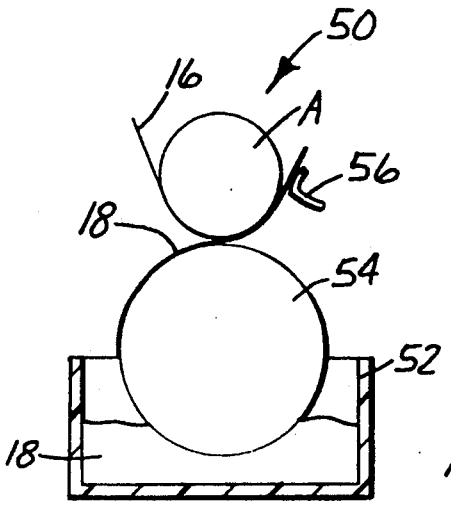
FIG. 5A shows roll coating without acoustic excitation and FIG. 5B shows roll coating with acoustic excitation.

Referring to FIG. 5, a roll coating system 50 is shown. In FIG. 5A, no ultrasonic excitation is provided. The coating system 50 includes a pan 52 containing liquid coating material 18 and a roll 54 mounted for rotation within the pan 52. The backup roller 14 is located adjacent the roll 54. The web 16 of material to be coated travels from left to right in the figure. The coating material 18 is applied to the web 16 across the desired width and a smoother or doctor blade 56 may be used to wipe off excess coating 18 and level or smooth the coating 18 on the web 16.

Figure 5B:
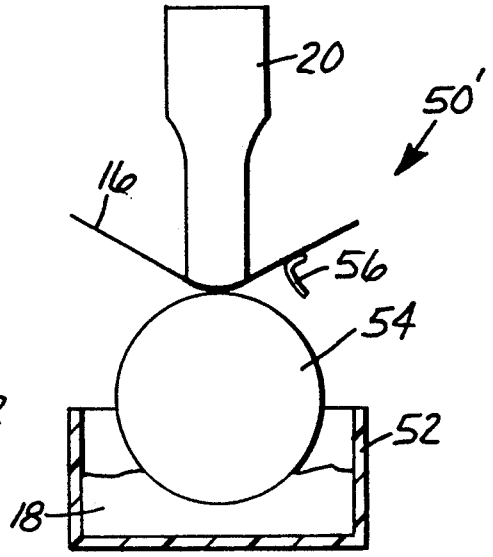

In FIG. 5B, ultrasonic energy is applied to the system 50' such that the energy acts on the web 16 and coating 18 in the region of initial contact between the web 16 and coating 18. This is accomplished by replacing the backup roller 14 with an ultrasonic horn 20. The ultrasonic energy is applied directly to the web 16 and excites the web 16 and coating 18 at the location of initial contact between the coating 18 and the web 16. Alternatively, when a doctor blade 56 is used as part of the coating applicator device 10 to level or smooth the coating 1B on the web 16, application of ultrasonic energy can be beneficially applied in the region of final contact between the coated web 16 and the downweb doctor blade. Thus, when the doctor blade is used, the ultrasonic energy need not reach the region of initial contact between the web 16 and the coating 18 as long as it reaches the region of final contact between the coated web 16 and the doctor blade. Ultrasonic energy also performs well with other coating systems including those with a plurality of rolls.

Figure 6A:
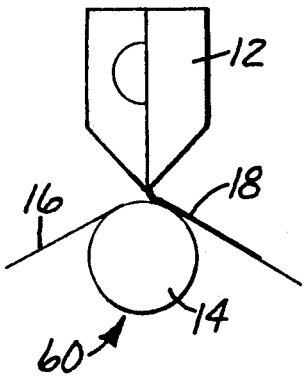
FIG. 6A shows extrusion coating without acoustic excitation and FIGS. 6B and 6C show extrusion coating with acoustic excitation.
Figure 6B:
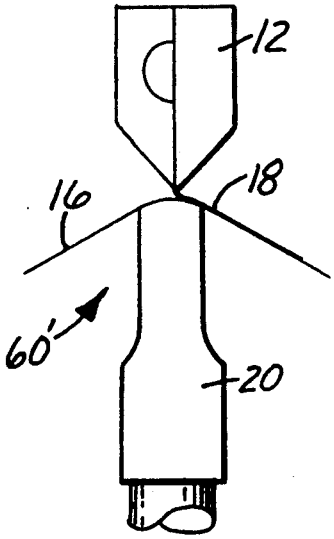
Figure 6C:
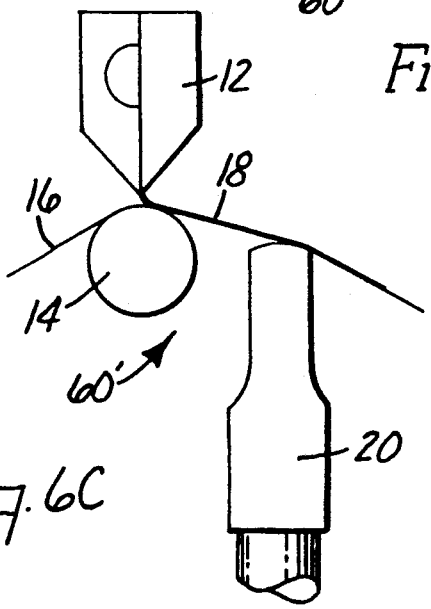

FIGS. 6A, 6B, and 6C correspond to FIGS. 1A, 1B, and 1C, respectively, and illustrate non-contact extrusion coating systems 60, 60'.

In one arrangement for all of the coating configurations, the ultrasonic source is located at the line of initial contact between the coating material and the web. Preferably, the ultrasonic energy is applied at the backside of the web through an ultrasonic horn used in place of a backup roll or other support. However, the ultrasonic source can be located remotely from the initial contact line to apply energy to the coated or uncoated web as long as sufficient ultrasonic energy reaches the line of initial contact. The maximum distance is about 15 cm although the best results have been found to occur within 8 cm. Alternatively, as discussed with respect to FIG. 2, the ultrasonic energy can be applied within 15 cm of the location of any downweb leveling or smoothing structure. Also, the ultrasonic energy can excite the area between the region of initial contact of the coating material and the web and the region of final contact between the coating applicator device or downweb structure and the coating material. The ultrasonic energy can be applied at any one or a combination of these areas.

Regardless of the location of the ultrasonic energy source, the ultrasonic energy adds energy to the coating liquid. As the acoustic energy intensity increases, the coating quality and processibility, including the thickness uniformity, improves until an optimum acoustic intensity level is reached. Acoustic energy preferably is applied near this optimum level which is at intensity levels between 0.1 $W/cm^2$ and 40 $W/cm^2$, depending on the kind of coater and the type of material being coated. However, the application of ultrasonic energy can create web vibrations such as surface acoustic waves which apply energy to the coating. Depending on the magnitude of the vibration, this can improve or degrade the coating quality. Care must be taken to avoid adverse affects such as lower frequency standing waves which yield coating nonuniformity.

The application of ultrasonic energy through a backup horn that generally replaces a backup roller is the preferred arrangement in all coating configurations. The ultrasonic energy can be applied to the web by direct contact or through any medium which transmits a sufficient amount of energy such as a coupling fluid. The working surface of the horn itself, and also the web in contact with the horn, is at or near a pressure node in the acoustic standing wave. As the ultrasonic energy is transmitted and reflected by the web and the coating material, the combined waves pull coating material toward the horn pressure node and toward the web. This improves drawdown in extrusion coating and provides a more stable liquid contact line in both extrusion and curtain coating. The coating material is urged to the web and reduces the tendency for air entrainment between the coating and the web. Other desirable effects that improve wettability include phenomena such as ultrasonic viscosity reduction and contact line and bulk fluid dynamics with the associated fluid momentum contributions. Furthermore, because the horn is a rigidly mounted, nonrotating, low friction surface, backup roll runout and the associated downweb variations are eliminated. If desired, a carrier web could be used to shield the moving coated web from the stationary ultrasonic horn.

If the region of initial contact between the coating material and web is confined by another structure, as with the slot-fed knife system of FIGS. 3B and 3D, additional effects may occur. Because the coating material forms a thin layer between two acoustically-matched materials, the transmission of acoustic energy is greatly enhanced. The acoustic energy density in the coating material between the die and the web is much greater than that outside this region. Moreover, if a low coating weight or void streak occurs in the coating area, the acoustic energy density in this area is lower and an increased fluid crossflow occurs which fills in the streak. The increased energy density of the fluid in the coating area increases the crossweb flow, reduces streaks, reduces the tendency for air entrainment, and results in better crossweb uniformity and a flow configuration which is more resistant to external disturbances. Additionally, the system can operate with larger gaps between the die and the web. This permits operating with larger process tolerances as the die position is not as critical as when ultrasonic energy is not used. The use of larger coating gaps reduces web tear-out problems. Also, machining variations on the die faces become a smaller percentage of the total coating gap and their adverse effect on coating uniformity is reduced.

The preferred frequency of vibration for the acoustic energy is at the low end of the ultrasonic spectrum at 20,000 Hz. However, because the benefits of ultrasonically-assisted coating are not highly dependent on frequency, a broad range of high and low frequencies is functional. Although lower frequencies are audible and present noise control problems, they can be used when higher amplitudes are required as with more viscous liquids or for scale-up of larger systems. Higher frequency ultrasonic systems present scale-up problems because they are smaller due to the shorter wavelengths that accompany higher frequencies. However, high frequency systems may be preferred for lower viscosity (less than 500 cps) liquids as they generate fewer low frequency resonances.

Peak-to-peak amplitudes of ultrasonic vibration between 0.002 mm and 0.20 mm have been tested in ultrasonically-assisted coating. The higher amplitudes are more useful for highly viscous liquids or thin layers whereas lower viscosity liquids or thick layers require lower amplitudes. For example, in a slot-fed knife system with a 5,000 cps solvent-based rubber coating, a peak-to-peak amplitude of 0.03 mm at 20,000 Hz is L sufficient to observe the desired improvements in coating quality. If the amplitude is too large, coating uniformity can be disrupted by localized nonuniformities such as rippling effects.

Figure 1E:
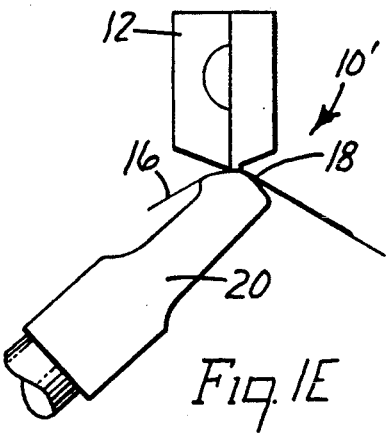
Figure 1F:
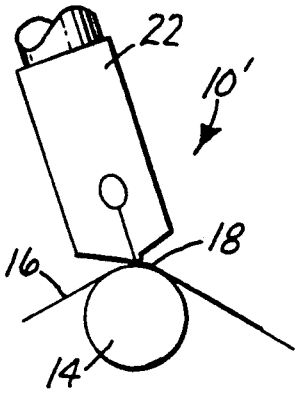
Figure 1G:
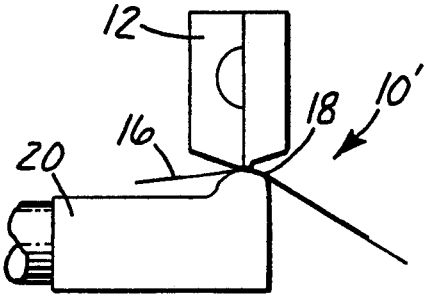

The angle of input of the ultrasonic waves preferably is perpendicular to the direction of web travel, as shown in FIGS. 1B and 1C. However, while this orientation is preferred, the angle of input can range from perpendicular to parallel to the plane of the web 16. FIGS. 1E and 1F show systems similar to FIGS. 1B and 1C in which the ultrasonic energy is transmitted through an ultrasonic horn 20 and an ultrasonic die 22, respectively. In these embodiments, the horn 20 and the die 22 transmit the ultrasonic energy at an angle between 0° and 90°. In FIG. 1G, the ultrasonic horn 20 transmits the ultrasonic energy in a direction parallel to the plane of the web 16 such that the amplitude of vibration of the ultrasonic energy lies in the direction of web 16 travel.

If ultrasonic energy is applied through the coating die (as in FIGS. 1D and 3D) it also effects the flow of coating material in the die. It has been found that in some instances when the pumping force is held constant, the flow rate through the die is doubled when ultrasonic energy is applied parallel to the liquid motion and the flow rate is improved by a factor of five when it is applied in the perpendicular direction. In addition, ultrasonic excitation of the die increases the temperature of the coating material which improves the natural flow of coating from the die. Also, debris stuck in die crevices can be coaxed out of the die by ultrasonic excitation, thus eliminating the presence of streaks in the coated web due to trapped debris. The die is preferably excited as a standing wave. Alternatively, the ultrasonic vibrations can be applied as a traveling wave propagating through the die, either with or without the use of a coupling material.

Figure 7A:
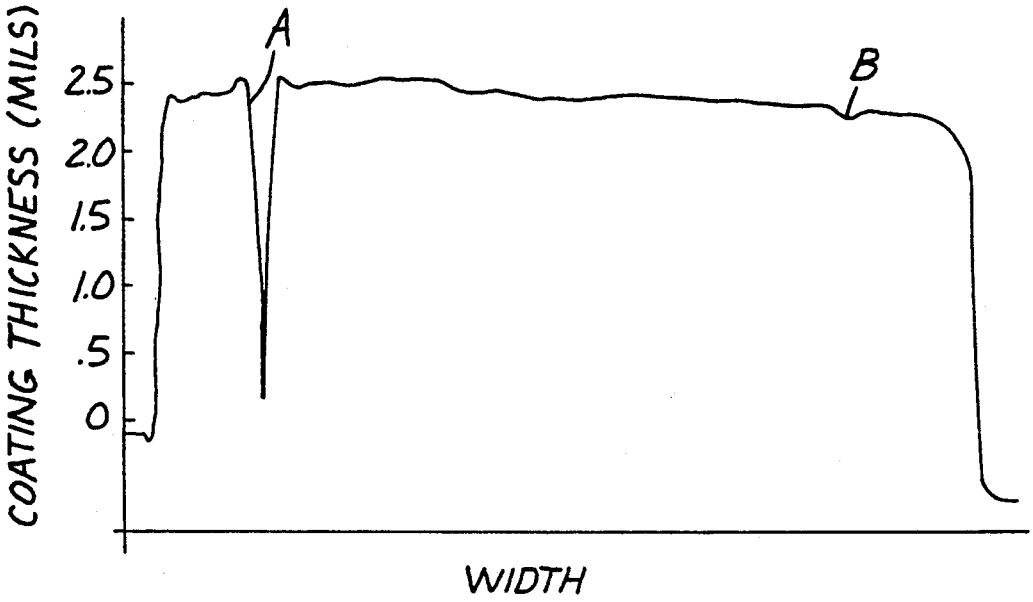
FIG. 7A is a graph of a cross web coating thickness profile without ultrasonics and FIG. 7B is a graph of the cross web coating thickness profile coated with ultrasonics.
Figure 7B:
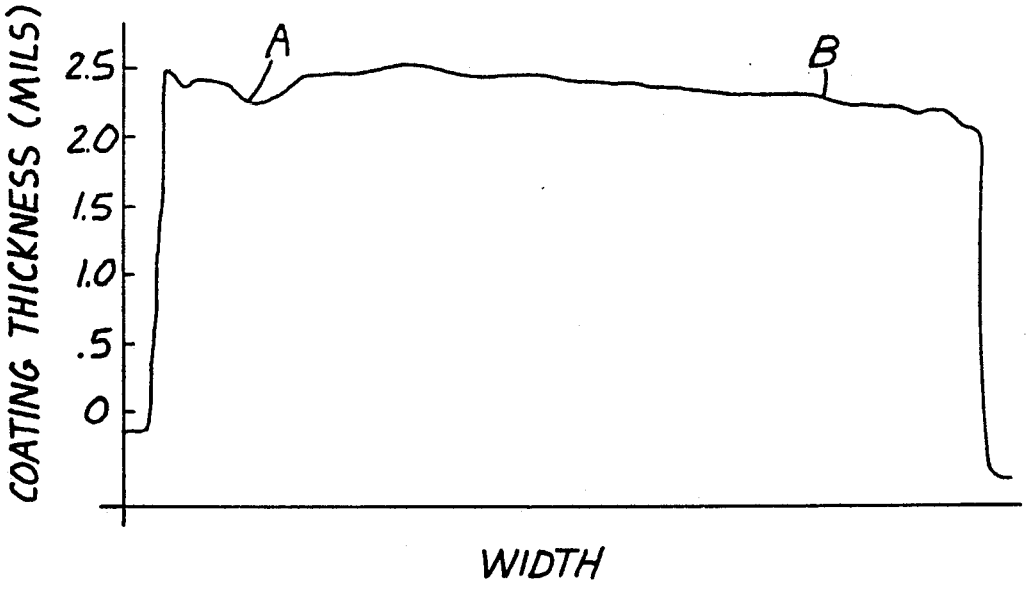

Many series of experiments with various fluids have been run. In one experiment, a 30 cm (12 in) wide knife die with an ultrasonic backup horn was used. A rubber-based adhesive was coated at a web speed of 7.62 m/min (25 ft/min) at 0.0635 mm (0.0025 in) thick. The ultrasonic amplitude was about 0.0305 mm (0.0012 in) peak-to-peak. One area in the die was intentionally plugged for about 1 mm (0.04 in) to simulate a clogged die and demonstrate the ability of the ultrasonics to compensate with sufficient crossflow in the coating nip to mask streaks. Cross web coating thickness profiles were taken and are illustrated in FIG. 7. The coating width on the web is shown along the x-axis and the coating thickness is shown along the y-axis. FIG. 7A shows coating without ultrasonics. A streak at area A was caused by the plug in the die orifice and a dip at area B was a naturally occurring thin coating area in the web. When the ultrasonics was turned on, the area A filled in to within 92% of the overall coating thickness and the area B dip was essentially eliminated, as shown in FIG. 7B.

Pilot plant data also was obtained. A run of 24,689 m (81,000 ft) of 61 cm (24 in) wide rubber-based adhesive tape was made at 15.24 to 30.48 m/min (50 to 100 ft/min) using a slot fed knife die with an ultrasonic backup horn. The ultrasonic amplitude was varied between 0.015 and 0.025 mm (0.0006 and 0.001 in) peak-to-peak. The coating was 0.030 mm (0.0012 in) thick and crossweb profiles were measured. Ten consecutive scans of 230 data points each were taken noting the range of the coating thickness and the standard deviation of the last scan, and the average range and standard deviation of all ten scans. (The range is the minimum to maximum crossweb coating thickness.) The ten scan groups were performed 17 times with ultrasonics and 9 times without ultrasonics.

Figure 8A:
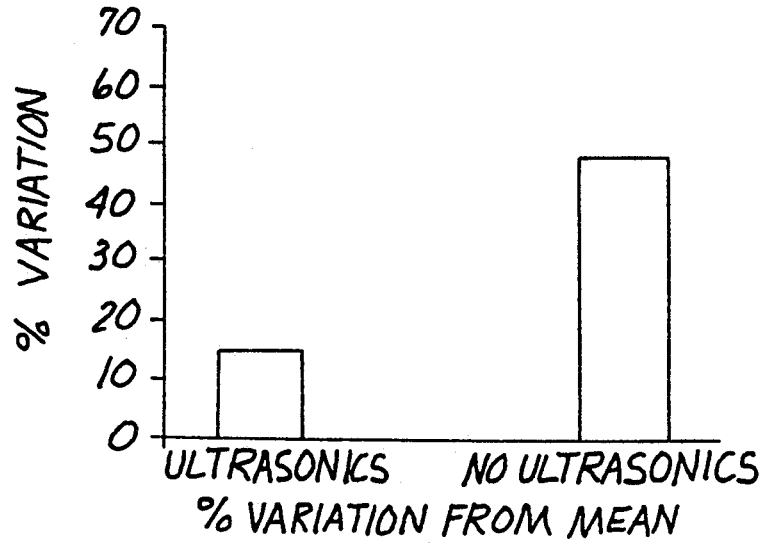
FIG. 8A is a graph comparing the average percentage coating thickness range variation for test runs with ultrasonics and for test runs without ultrasonics.
Figure 8B:
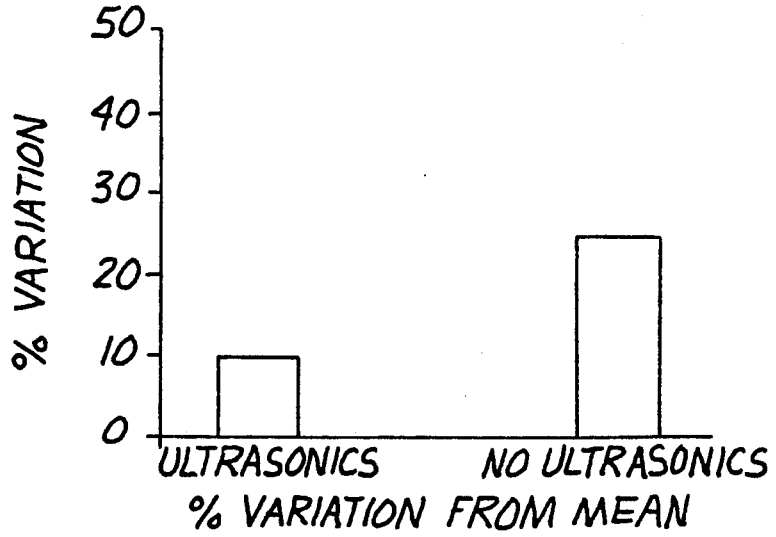
FIG. 8B is a graph comparing the coating thickness standard deviation variation as a percentage for test runs with ultrasonics and for test runs without ultrasonics.

An indication of transient coating thickness variation can be determined by considering how much the range of a single scan varies from the average range of several scans before it. The coating range variations that occur with time therefore can be indicated by subtracting the average range of the ten scans from the tenth scan of a group of ten scans, taking the absolute value, and dividing by the average range. This is performed for all of the groups of ten scans, then averaged. FIG. 8A compares the average range variation as a percentage for the scan groups with ultrasonics with the scan groups without ultrasonics. Ultrasonics reduces the percent variation from 47% to 15%, a three-fold reduction. FIG. 8B compares the standard deviation variations of the runs with and without ultrasonics. The standard deviation variation percentages were reduced from 25% to 10% when ultrasonics was used. These figures show the improved consistency of the overall crossweb caliper profile as a function of run time. Once a desired coating profile has been established, the profile varies less with time when ultrasonics is present than without ultrasonics.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention. For example, instead of using a sonotrode as the ultrasonic energy source, eccentric cams or white noise generators can be used to improve coatings. Additionally, acoustic energy can be applied to both sides of the web.

We claim:

1. A method of applying on only one surface of a moving web at least one layer of fluid coating material having a substantially uniform crossweb thickness comprising:

metering a controlled amount of coating material; and coating the web, wherein the coating step comprises:

applying, separately from the metering step, the metered amount of coating material onto at least a portion of only one surface of the web;

acoustically exciting, as part of the coating step and using an energy generator, the coating material to improve the uniformity of coating material as it is applied, the line of initial contact between the coating material and the web from the surface opposite to the surface on which the coating material is applied by applying acoustic energy to the back surface of the web and through the web without any substantial air gap between the back surface of the web and the energy generator at a substantially uniform acoustic intensity while the coating is fluid and before any substantial drying of the coating occurs; and selecting the acoustic intensity in combination with the properties of the coating material to create a coated web having a substantially uniform crossweb thickness perpendicular to the direction of movement of the web.

2. The method of claim 1 wherein the exciting step comprises applying acoustic energy to at least part of a region of the coated web extending fifteen cm on either side of the line of initial contact between the coating material and the web.

3. The method of claim 2 wherein the exciting step comprises supporting an maintaining substantial contact with the back surface of the moving web.

4. The method of claim 1 wherein the exciting step comprises exciting at ultrasonic levels.

5. The method of claim 1 wherein the exciting step generates acoustic waves having substantially uniform amplitude and frequency.

6. The method of claim 1 wherein the exciting step comprises generating acoustic waves at an angle with the web ranging from perpendicular to the plane of the web to parallel to the plane of the web.

7. The method of claim 1 wherein the applying step comprises applying the metered amount of coating material as a continuous layer on the web.

8. The method of claim 1 wherein the applying step comprises applying the metered amount of coating material onto a plurality of portions of only one surface of the web wherein the coated portions are discontinuous from each other in both the downweb and crossweb directions, and wherein the exciting step creates a coated web having a plurality of coated portions having a substantially uniform and equal crossweb thickness perpendicular to the direction of movement of the web.

9. The method of claim 1 wherein the acoustically exciting step comprises contacting the web with an acoustic energy generator.

10. The method of claim 1 wherein the acoustically exciting step comprises contacting the web with a non-gas energy transmissive coupling medium and applying the acoustic energy to the energy transmissive coupling medium.

11. A method of applying on only one surface of a moving web at least one layer of fluid coating material having a substantially uniform crossweb thickness comprising:

metering a controlled amount of coating material; and coating the web, wherein the coating step comprises:

applying, separately from the metering step, the metered amount of coating material onto at least a portion of only one surface of the web;

smoothing the applied coating material downweb of the applying location using a smoothing structure;

acoustically exciting, as part of the coating step and using an energy generator, the coating material to improve the uniformity of coating material as it is applied, at least one of the line of initial contact between the coating material and the web, the line of final contact between the smoothing structure and the coating, and any point between the lines of initial and final contact from the surface opposite to the surface on which the coating material is applied by applying acoustic energy to the back surface of the web and through the web without any substantial air gap between the back surface of the web and the energy generator at a substantially uniform acoustic intensity while the coating is fluid and before any substantial drying of the coating occurs; and selecting the acoustic intensity in combination with the properties of the coating material to create a coated web having a substantially uniform crossweb thickness perpendicular to the direction of movement of the web.

12. The method of claim 11 wherein the exciting step comprises applying acoustic energy to at least part of a region of the web extending from fifteen cm upweb of the line of initial contact between the coating material and the web to fifteen cm downweb of the downweb smoothing structure.

* * * * *

UNITED STATES PATENT AND TRADEMARK OFFICE

CERTIFICATE OF CORRECTION

PATENT NO. : 5,262,193

DATED : November 16, 1993

INVENTOR(S) : John W. Louks, Donald L. Pochardt, Robert B. Secor, Karl J. Warren It is certified that error appears in the above-indentified patent and that said Letters Patent is hereby corrected as shown below:

Col. 7, Line 29, "1B" should read --18--.

Col. 9, Line 16, delete "L".

Col. 11, Line 25, "an" should read --and--.

Signed and Sealed this

Thirtieth Day of August, 1994

Bruce Lehman

*Attest:*

BRUCE LEHMAN

*Attesting Officer*

*Commissioner of Patents and Trademarks*